US006492943B1

(12) United States Patent
Marumoto et al.

(10) Patent No.: US 6,492,943 B1
(45) **Date of Patent: *Dec. 10, 2002**

(54) PHASED-ARRAY ANTENNA APPARATUS

(75) Inventors: Tsunehisa Marumoto; Yasunori Yoshino; Youichi Ara; Tomoaki Saryo; Kenichiro Suzuki, all of Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/698,191

(22) Filed: Oct. 30, 2000

Related U.S. Application Data

(63) Continuation of application No. 09/100,981, filed on Jun. 22, 1998, now Pat. No. 6,232,919.

(30) Foreign Application Priority Data

Jun. 23, 1997 (JP) ..... 9-166346

(51) Int. Cl.[7] ..... H01Q 3/22; H01Q 3/24; H01Q 3/26

(52) U.S. Cl. ..... 342/372

(58) Field of Search ..... 342/372, 368; 343/700 MS

(56) References Cited

U.S. PATENT DOCUMENTS

| | | | | | |
|---|---|---|---|---|---|
| 4,346,315 | A | * | 8/1982 | Roberts | 307/603 |
| 4,490,721 | A | * | 12/1984 | Stockton et al. | 342/368 |
| 5,038,148 | A | * | 8/1991 | Aoki et al. | 342/372 |
| 5,381,157 | A | * | 1/1995 | Shiga | 343/700 MS |
| 5,526,172 | A | * | 6/1996 | Kanack | 359/291 |
| 5,628,053 | A | * | 5/1997 | Araki et al. | 343/700 MS |
| 5,661,494 | A | * | 8/1997 | Bondyopadhyay | 343/700 MS |
| 5,717,231 | A | * | 2/1998 | Tserng et al. | 343/789 |
| 5,818,385 | A | * | 10/1998 | Bartholomew | 342/372 |

FOREIGN PATENT DOCUMENTS

| | | | |
|---|---|---|---|
| JP | 58-95402 | * | 6/1983 |
| JP | 63-3207 | * | 1/1988 |
| JP | 2-183605 | * | 7/1990 |
| JP | 3-85927 | * | 4/1991 |
| JP | 4-54705 | * | 2/1992 |
| JP | 4-150502 | * | 5/1992 |
| JP | 5-2976 | * | 1/1993 |
| JP | 5-18282 | * | 3/1993 |
| JP | 5-335802 | * | 12/1993 |
| JP | 6-253477 | * | 9/1994 |
| JP | 6-326510 | * | 11/1994 |
| JP | 8-213803 | * | 8/1996 |

OTHER PUBLICATIONS

Daniel J. Bem et al. "Microstrip Phased Array for Mobile Satellite Terminals". 1995 IEEE. pp. 1446–1449.

Daniel J. Bem et al, "Microstrip Phased Array for Mobile Satellite Terminals", 1995 IEEE, pp. 1446–1449.*

* cited by examiner

*Primary Examiner*—Theodore M. Blum
(74) *Attorney, Agent, or Firm*—Sughrue Mion, PLLC

(57) ABSTRACT

A phased-array antenna apparatus used in a microwave or milliwave band and having a high gain includes a multilayer structure. The multilayer structure is constituted by M radiating elements, M phase shifters, phase shifting control circuits, and a feeding unit. The phase shifters are respectively coupled to the radiating elements to shift the phase of a feeding signal supplied to each of the radiating elements in units of N (M and N are integers equal to or larger than two) bits. The phase shifting control circuits control phase shifting of the phase shifters. The feeding unit is arranged to be coupled to each of the radiating elements.

1 Claim, 14 Drawing Sheets

SIGNAL LINE 61

SCANNING LINE 62

OUTPUT Q1 FROM LATCH CIRCUIT 63

TIMING SIGNAL b

OUTPUT Q2 FROM LATCH CIRCUIT 64
p
q
r
s
PERIOD T
PERIOD T

SIGNAL LINE 61

SCANNING LINE 62

OUTPUT Q1 FROM LATCH CIRCUIT 63

TIMING SIGNAL b

OUTPUT Q2 FROM LATCH CIRCUIT 64
[H]
p
q
r
s
PERIOD T
PERIOD T

PHASED-ARRAY ANTENNA APPARATUS

This Application is a continuation of Ser. No. 09/100,981 Jun. 22, 1998 U.S. Pat. No. 6,232,919.

BACKGROUND OF THE INVENTION

The present invention relates to a phased-array antenna apparatus which is used in a microwave or milliwave band to change the feeding phases for radiating elements by using digital phase shifters.

A phased-array antenna apparatus is an antenna which scans a radiant beam by electronically changing the feeding phases for a plurality of radiating elements. Phase shifters are respectively connected to the radiating elements. The feeding phases for the radiating elements can be changed by controlling the phase shifters.

In general, a digital phase shifter with 3 to 5 bits (to be simply referred to as a digital phase shifter hereinafter) is used as each phase shifter. The phase shift amounts of feeding phases are set by ON/OFF-operating the respective bits of the phase shifters. As switches for the respective bits of the phase shifters, semiconductor devices such as PIN diodes or GaAs FETs are used.

The phase shifters are controlled by a control unit. This control unit is connected to each phase shifter through a driving circuit therefor. The control unit and the respective driving circuits are externally mounted on a substrate on which the radiating elements and the phase shifters are formed.

The control unit calculates the optimal phase shift amounts for the orientation of a radiant beam in a desired direction in units of radiating elements, and outputs the corresponding control signals. The driving circuits turn on/off the respective bits of the phase shifters on the basis of the control signals from the control unit.

To increase the gain of the phased-array antenna apparatus, the number of radiating elements may be increased. An increase in the number of radiating elements, however, will increase the number of phase shifters. As a result, many switches to be arranged for the respective bits of the phase shifters are required.

In a conventional phased-array antenna apparatus, modularized semiconductor devices are used as the switches of phase shifters. It takes much time and labor to mount modularized switches on the phase shifters. For this reason, the manufacturing cost of a high-gain phased-array antenna apparatus requiring many switches becomes high.

In addition, if the number of radiating elements is increased to increase the gain of the phased-array antenna apparatus, a large number of driving circuits are required for the respective phase shifters.

In a conventional phased-array antenna apparatus, modularized ICs (to be referred to as phase shifter driving ICs hereinafter) are used as driving circuits for phase shifters. For this reason, a large number of phase shifter driving ICs are required to implement a high-gain phased-array antenna apparatus. A large space is therefore required to allow a large number of IC modules to be externally mounted, resulting in an increase in the size of the phased-array antenna apparatus.

Furthermore, as the numbers of phase shifters and phase shifter driving ICs increase, the number of wiring lines for connecting the phase shifters to the phase shifter driving IC in units of bits increases. However, the number of wiring lines which can be formed within a limited area is limited. For this reason, a high-gain phased-array antenna apparatus has been realized with difficulty in forming wiring lines for controlling phase shifters.

SUMMARY OF THE INVENTION

The present invention has been made to solve the above problem, and has as its object to reduce the manufacturing cost of a high-gain phased-array antenna apparatus.

It is another object of the present invention to reduce the size of a high-gain phased-array antenna apparatus.

It is still another object of the present invention to simplify a wiring for controlling the phase shifters of a high-gain phased-array antenna apparatus.

In order to achieve the above objects, according to the present invention, there is provided a phased-array antenna apparatus used in a microwave or milliwave band and having a high gain, comprising a multilayer structure constituted by M radiating elements, M phase shifters respectively coupled to the radiating elements to shift a phase of a feeding signal supplied to each of the radiating elements in units of N (M and N are positive integers and M is not less than two) bits, phase shifting control circuits for controlling phase shifting of the phase shifters, and a feeding unit arranged to be coupled to each of the radiating elements.

DESCRIPTION OF THE PREFERRED EMBODIMENTS

The embodiments of the present invention will be described in detail below with reference to the accompanying drawings. The following description pertains to the transmission of a signal from the antenna as the flow of an RF signal as a feeding signal. Owing to the reciprocity theorem, however, the operation principle is essentially the same as in a case wherein the antenna receives a signal.

(First Embodiment)

Figure 1:
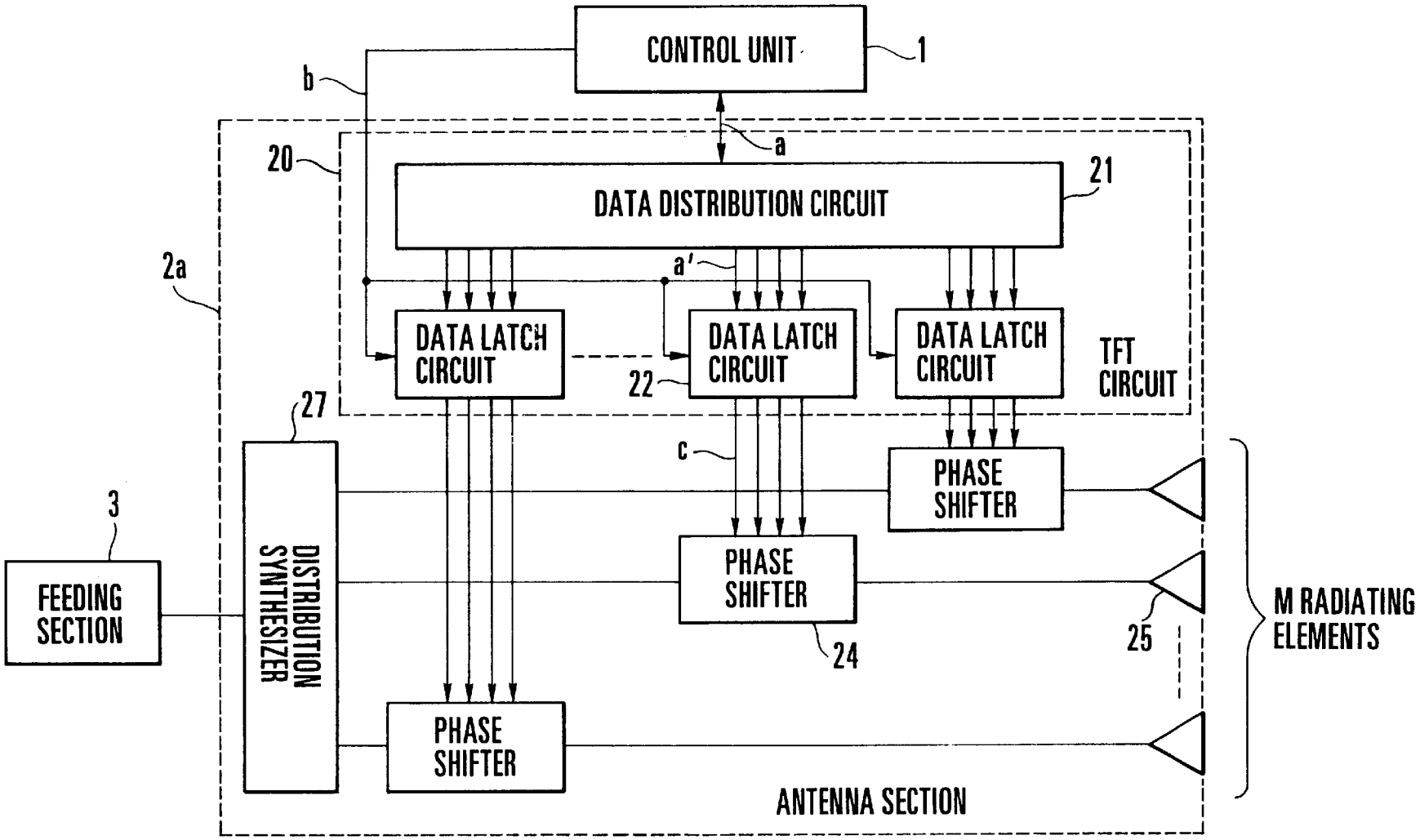
FIG. 1 is a block diagram showing a phased-array antenna apparatus according to the first embodiment of the present invention.

FIG. 1 shows the arrangement of a phased-array antenna apparatus according to the first embodiment of the present invention. The phased-array antenna apparatus in FIG. 1 has M (M is an integer equal to or larger than two) radiating elements 25. The respective radiating elements 25 are connected to N-bit (N is an integer equal to or larger than one or two) phase shifters 24. The phase shifters 24 are connected to a feeding section 3 through a distribution synthesizer 27. The phase shifters 24 are connected to a thin-film transistor circuit (to be referred to as a TFT circuit hereinafter) 20 for driving the phase shifters serving as phase shifting control circuits. The TFT circuit 20 is connected to a control unit 1.

The TFT circuit 20 is constituted by M data latch circuits 22 arranged for the respective phase shifters 24 and a data distribution circuit 21. The phase shifters 24 are respectively connected to the data latch circuits 22. The data latch circuits 22 are connected to the data distribution circuit 21. The control unit 1 is connected to the data distribution circuit 21 and the data latch circuits 22.

Each phase shifter 24 has a microwave switch for each bit. The respective data latch circuits 22 are connected to the microwave switches of the phase shifters 24.

The TFT circuit 20 is integrally formed with the radiating elements 25 and the phase shifters 24 on the same substrates and forms an antenna section 2*a,* together with the distribution synthesizer 27.

The control unit 1 calculates the optimal phase shift amounts for the orientation of a radiant beam in a desired direction in units of radiating elements 25, and outputs the resultant values as control signals (control data) a to the data distribution circuit 21. The control unit 1 also outputs a timing signal b for changing the beam direction to each data latch circuit 22. The data distribution circuit 21 outputs control signals a' to the respective data latch circuits 22 on the basis of the control signals a. The data latch circuits 22 apply driving voltages (data) c to the phase shifters 24 on the basis of the control signals a' in synchronism with the timing signal b.

The distribution synthesizer 27 distributes the RF signal output from the feeding section 3 and outputs the resultant signals to the phase shifters 24. The phase shift amounts of the phase shifters 24 are set by the driving voltages c applied from the data latch circuits 22. The phase shifters 24 change the feeding phases for the radiating elements 25 by the phase shift amounts. The radiating elements 25 then radiate radio waves with phases corresponding to the feeding phases.

The operation of the phased-array antenna apparatus in FIG. 1 will be described next.

The control unit 1 calculates the optimal phase shift amount for the orientation of a radiant beam in a desired direction for each of the M radiating elements 25 with a precision of N bits on the basis of the preset position of each radiating element 25 and the frequency to be used, and outputs the resultant value as the control signal a to the data distribution circuit 21.

The control signals a are distributed/supplied as the control signals a' to the respective data latch circuits 22.

Note that the radiating directions of all the radiating elements 25 of the antenna section 2*a* must be simultaneously changed instead of being gradually changed one by one. For this reason, the data latch circuits 22 rewrite the held data into the control signals a' as the input data in synchronism with the timing signal b for changing the beam direction, and simultaneously apply the driving voltages c to the microwave switches corresponding to the necessary bits of the phase shifters 24 on the basis of the held data (control signals a').

When the driving voltages c are applied to the microwave switches, the microwave switches close the circuits to turn on the corresponding bits. The phase amount of each phase shifter 24 is set depending on which bits are turned on.

Each phase shifter 24 changes the phase of an RF signal by the phase shift amount set in this manner, and feeds power to a corresponding radiating element 25. The respective radiating elements 25 radiate radio waves of phases corresponding to the feeding phases to form an equiphase surface, thereby forming a radiant beam in a direction perpendicular to the equiphase surface.

Figure 2:
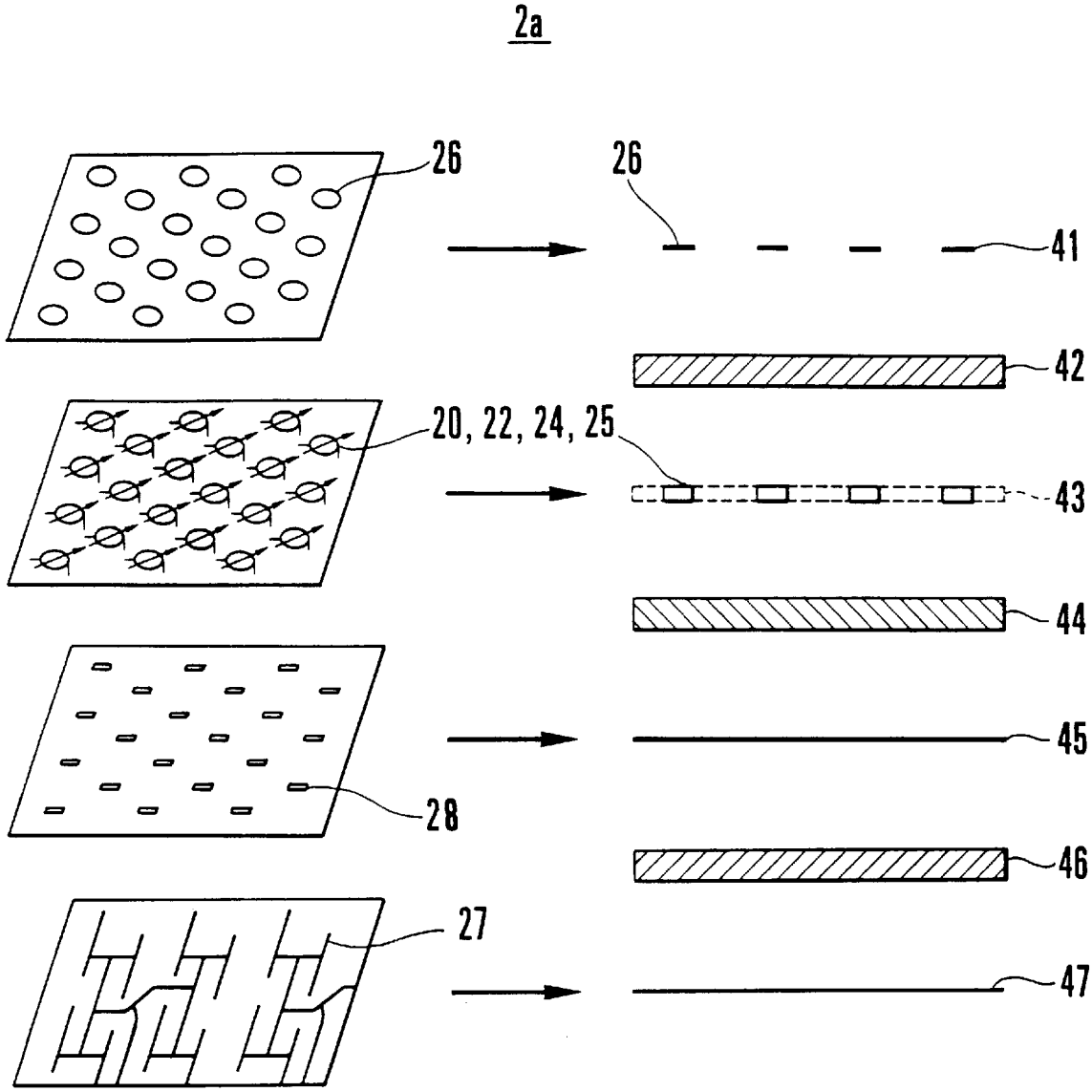
FIG. 2 is an exploded view showing the structure of the antenna section of the phased-array antenna apparatus in FIG. 1.

The structure of the antenna section 2*a* of the phased-array antenna apparatus in FIG. 1 will be described next. FIG. 2 shows the structure of the antenna section 2*a*.

As shown in FIG. 2, the antenna section 2*a* has a multilayer structure. More specifically, a passive element layer 41, a first dielectric layer 42, a radiating element/phase shifter/TFT circuit layer (to be referred to as a phase shifter layer hereinafter) 43, a second dielectric layer 44, a feeding slot layer 45, a third dielectric layer 46, and a distribution synthetic layer 47 are stacked on each other in the order named in tight contact with each other.

The respective layers are formed into the multilayer structure by a printing technique, stacking, or bonding. For example, the passive element layer 41 and the phase shifter layer 43 are formed on the upper and lower surfaces of the dielectric layer 42, and the feeding slot layer 45 is formed on one surface of the dielectric layer 44 by the printing technique or the like.

Passive elements 26 are formed on the passive element layer 41. Although the passive elements 26 are not shown in FIG. 1, the band of the antenna can be broadened by using the passive elements 26. The passive elements 26 are electromagnetically coupled to the radiating elements 25 of the phase shifter layer 43 on the phase shifter layer 43 through the dielectric layer 42.

The dielectric layer 42 is made of a dielectric having a dielectric constant of about 2 to 10. If, for example, a glass material is used for the dielectric layer 42, the manufacturing cost can be reduced. Obviously, if no consideration is to be given to the manufacturing cost, the dielectric layer 42 may be made of other dielectrics such as alumina having a high dielectric constant and a foamed material having a low dielectric constant.

The radiating elements 25, the phase shifters 24, and the TFT circuit 20 (including the data latch circuits 22), which are shown in FIG. 1, are formed on the phase shifter layer 43, together with the strip lines for feeding power to the radiating elements 25. As described above, in the phased-array antenna apparatus shown in FIG. 1, the driving circuit for the phase shifters, which is an external IC in the prior art, is formed as the TFT circuit 20 on the same layer on which the radiating elements 25 and the phase shifters 24 are formed.

The dielectric layer 44 is made of a dielectric having a dielectric constant of about 3 to 12, e.g., alumina.

Feeding slots 28 serving as feeding coupling means are formed in the feeding slot layer 45. The distribution synthesizer 27 shown in FIG. 1 is formed on the distribution synthetic layer 47. The distribution synthesizer 27 is electromagnetically coupled to the phase shifter layer 43 through the feeding slot layer 45. A feeding unit is constituted by the distribution synthesizer 27 and the feeding slots 28.

Power is fed from the feeding slots 28 to the radiating elements 25 through the phase shifters 24 and the strip lines. The feeding slot layer 45 also serves as a ground layer, which grounds the phase shifter layer 43 through the through holes (not shown) properly formed in the dielectric layer 44.

A set of each passive element 26, each radiating element 25, each phase shifter 24, each data latch circuit 22 of the TFT circuit 20, and each feeding slot 28, which are formed on the respective layers described above, constitutes one unit. The respective units are arranged in the form of a matrix.

As described above, the respective units are arranged in the form of a matrix in FIG. 2. The present invention is, however, effective even if the respective units are not arranged in the form of a matrix.

It suffices if the radiating elements 25 are arranged in the form of a matrix. The present invention is also effective even if the radiating elements 25 are simply arranged in a two-dimensional form, or aligned in one direction.

In the arrangement in FIG. 2, the radiating elements 25, the phase shifters 24, and the TFT circuit 20 are formed on one surface of the dielectric layer 42. However, the phase shifters 24 and the TFT circuit 20 can be formed on surface of the dielectric layer 42, while the radiating elements 25 can be formed on the other surface. In this case, the radiating elements 25 are electromagnetically coupled to the strip lines connected to the phase shifters 24 through the dielectric layer 42.

Figure 13:
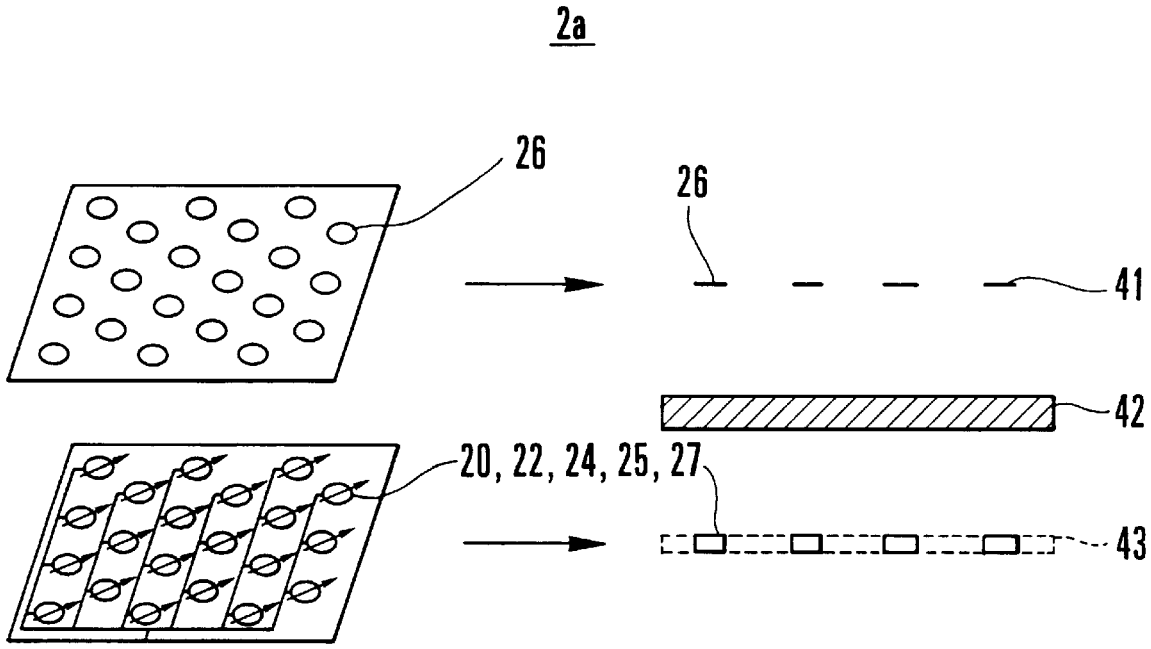
FIG. 13 is a developed view showing another structure of the antenna section of the phased-array antenna apparatus in FIG. 1.

In addition, in the arrangement in FIG. 2, the distribution synthesizer 27 and the phase shifter layer 43 are electromagnetically coupled to each other through the feeding slot layer 45. The present invention is, however, effective even if the distribution synthesizer 27 and the phase shifter layer 43 are connected to each other through other feeding coupling means such as feeding pins, or the distribution synthesizer 27 is formed to be flush with the phase shifter layer 43, as shown in FIG. 13.

Figure 14:
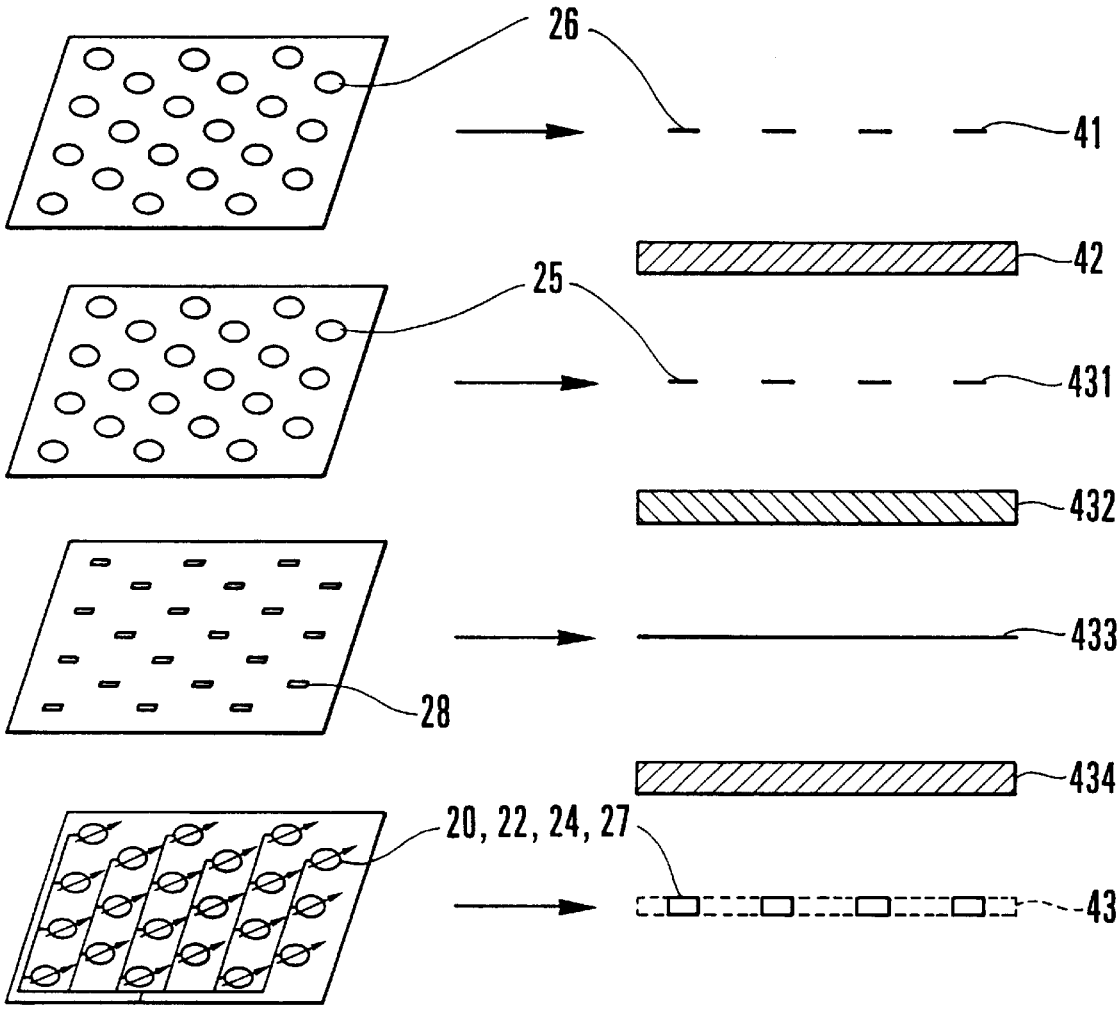
FIG. 14 is a view showing still another structure of the antenna section of the phased-array antenna apparatus in FIG. 1.
Figures 15A, 15B, 15C, 15D, 15E:
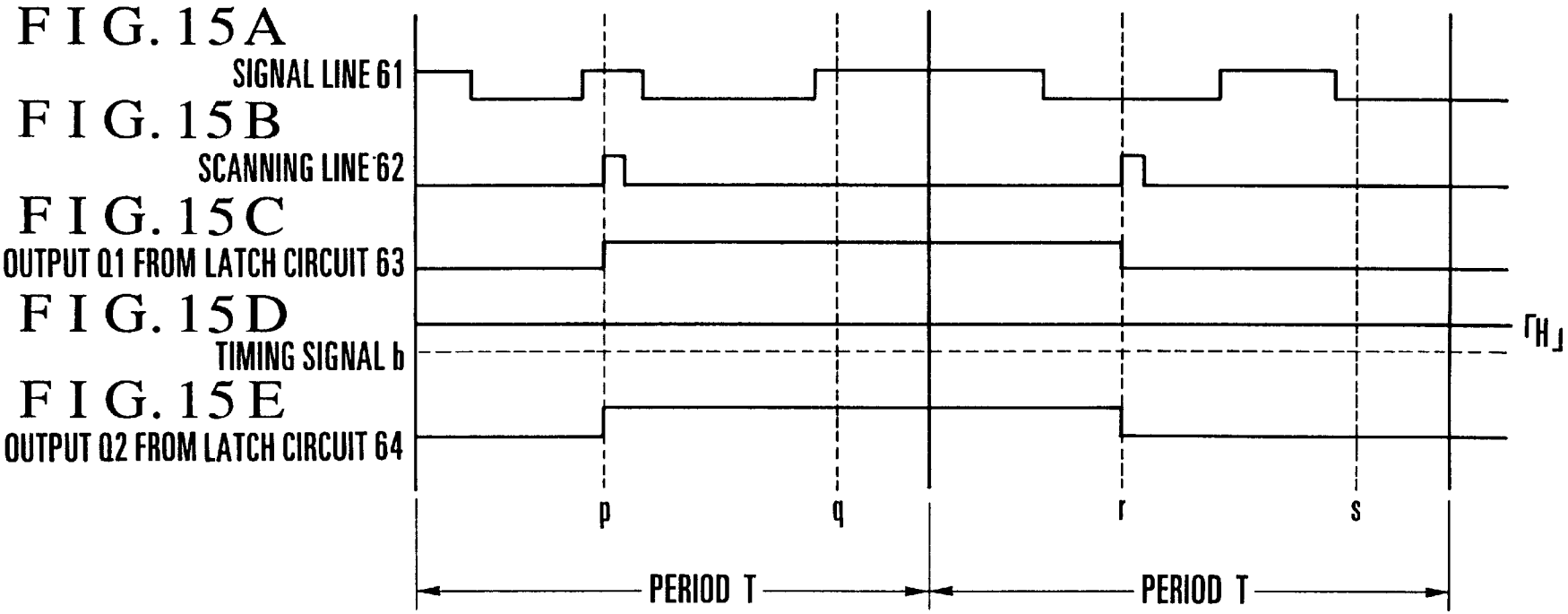
FIGS. 15A to 15E are timing charts showing another operation of the data latch circuit 22' in FIG. 5.

As shown in FIG. 14, the present invention is also effective when a radiating element layer 431 is formed independently of the phase shifter layer 43, and radiating elements 25 on the radiating element layer 431 are electromagnetically excited through fourth and fifth dielectric layers 432 and 434 and a feeding slot layer 433.

Figure 3:
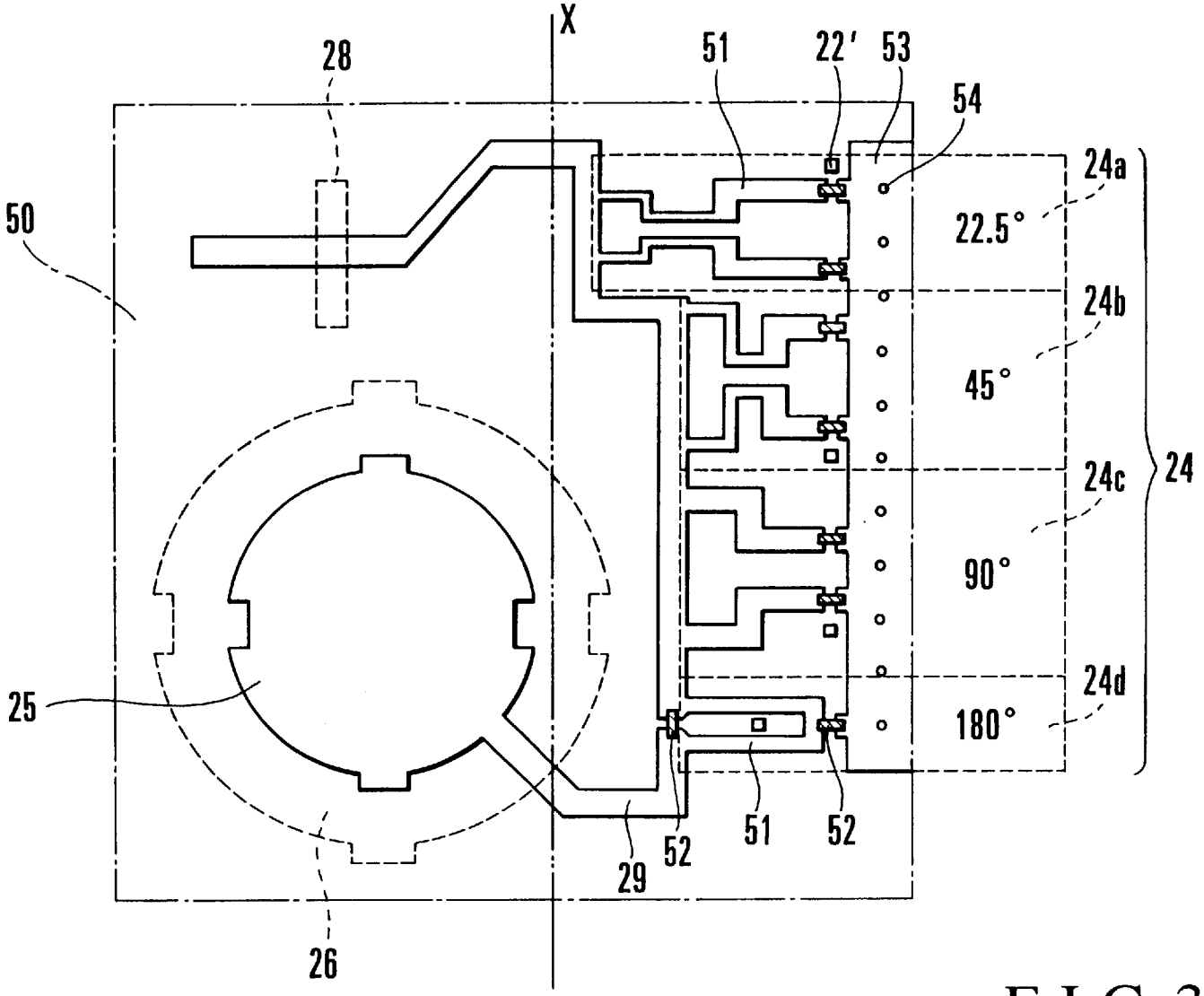
FIG. 3 is a view showing the arrangement of one unit on a phase shifter layer in FIG. 2.

The phase shifter layer 43 in FIG. 2 will be described further in detail. FIG. 3 shows the arrangement of one unit on the phase shifter layer 43. FIG. 3 shows a case wherein a glass material is used for the dielectric layer 42 in FIG. 2.

The radiating element 25, the phase shifter 24, and the data latch circuit 22 are formed on a glass substrate (dielectric substrate) 50. Note that the data latch circuit 22 is constituted by data latch circuits 22' arranged for the respective bits of the phase shifter 24, and FIG. 3 shows the data latch circuits 22'.

A strip line 29 is printed to extend from the radiating element 25 to a position, on the glass substrate 50, which corresponds to the feeding slot 28 in FIG. 2 through the phase shifter 24.

The radiating element 25 and the feeding slot 28 are formed on the same side (left side) of a coordinate axis X, and the phase shifter 24 and the data latch circuit 22' are formed on the different side (right side) of the coordinate axis X.

As the radiating element 25, a patch antenna, a printed dipole, a slot antenna, an aperture element, or the like is used.

As the strip line 29, a distributed constant line such as a micro-strip line, a triplate line, a coplanar line, or a slot line is used.

The phase shifters 24 are arranged around the radiating elements 25. The phase shifters 24 are 4-bit phase shifters. Each phase shifter is constituted by four phase shifters 24*a*, 24*b*, 24*c*, and 24*d*. The phase shifting elements 24*a* to 24*c* can change the feeding phase by 22.5°, 45°, 90°, and 180°, respectively.

To prevent confusion of the phase shifter 24 and the phase shifters 24*a* to 24*d* constituting the phase shifter 24, the phase shifters 24*a* to 24*d* will be discriminated by calling them the phase shifting elements 24*a* to 24*d*.

Each of the phase shifting elements 24*a*, 24*b*, 24*c*, and 24*d* is constituted by strip lines 51 and microwave switches. As each strip line 51, a distributed constant line such as a micro-strip line, a triplate line, a coplanar line, or a slot line is used. As each microwave switch, a micromachine switch 52 is used.

Each of the phase shifting elements 24*a* to 24*c* is designed such that one portion of each of the two strip lines (second and third distributed constant lines) 51 is connected to the strip line (first distributed constant line) 29 at some midpoint, and the two micromachine switches (first and second microwave switches) 52 are arranged to connect the other end portion of each of the two strip lines 51 to ground 53.

The phase shifting element 24*d* is designed such that the two end portions of the U-shaped strip line (sixth distributed constant line) 51 are connected to the two end portions of the cut strip line (fourth and fifth distributed constant lines) 29, on e micromachine switch (third microwave switch) 52 is placed to connect the two end portions of the strip line 29, and the other micromachine switch (fourth microwave switch) 52 is placed to connect the middle portion of the strip line 51 to the ground 53.

The former type of phase shifter is called a loaded line phase shifter; and the latter type, a switched line phase shifter. In general, when the phase shift amount is small, good characteristics can be obtained with a loaded line type phase shifter. In contrast to this, when the phase shift amount is large, good characteristics can be obtained with a switched line phase shifter.

For this reason, the loaded line phase shifters are used as the phase shifting elements 24*a* to 24*c* with 22.5°, 45°, and 90°, whereas the switched line phase shifter is used as the phase shifting element 24*d* with 180°. Switched line phase shifters, however, can be used as the phase shifting elements 24*a* to 24*c*.

Alternatively, phase shifting circuits other than the loaded line type and the switched line type, e.g., line switching type, can be used for the phase shifting elements 24*a*, 24*b*, 24*c*, and 24*d*.

The two micromachine switches 52 of each of the phase shifting elements 24*a*, 24*b*, 24*c*, and 24*d* are connected to the data latch circuit 22' placed nearby. The two micromachine switches 52 are simultaneously operated by the driving voltage c output from the data latch circuit 22'. The two micromachine switches 52 selectively ground the strip lines 51 or selectively connect the disconnected strip line 29.

With this operation, the feeding phase can be changed by passing an RF signal flowing in the strip line 29 to the strip lines 51.

According to the above description, the data latch circuits 22' are arranged near the micromachine switches 52. A plurality of data latch circuits 22', however, may be arranged in one place, and wiring lines may extend therefrom to drive the micromachine switches 52.

One data latch circuit 22' may be connected to the micromachine switches 52 of a plurality of different units.

Figure 4:
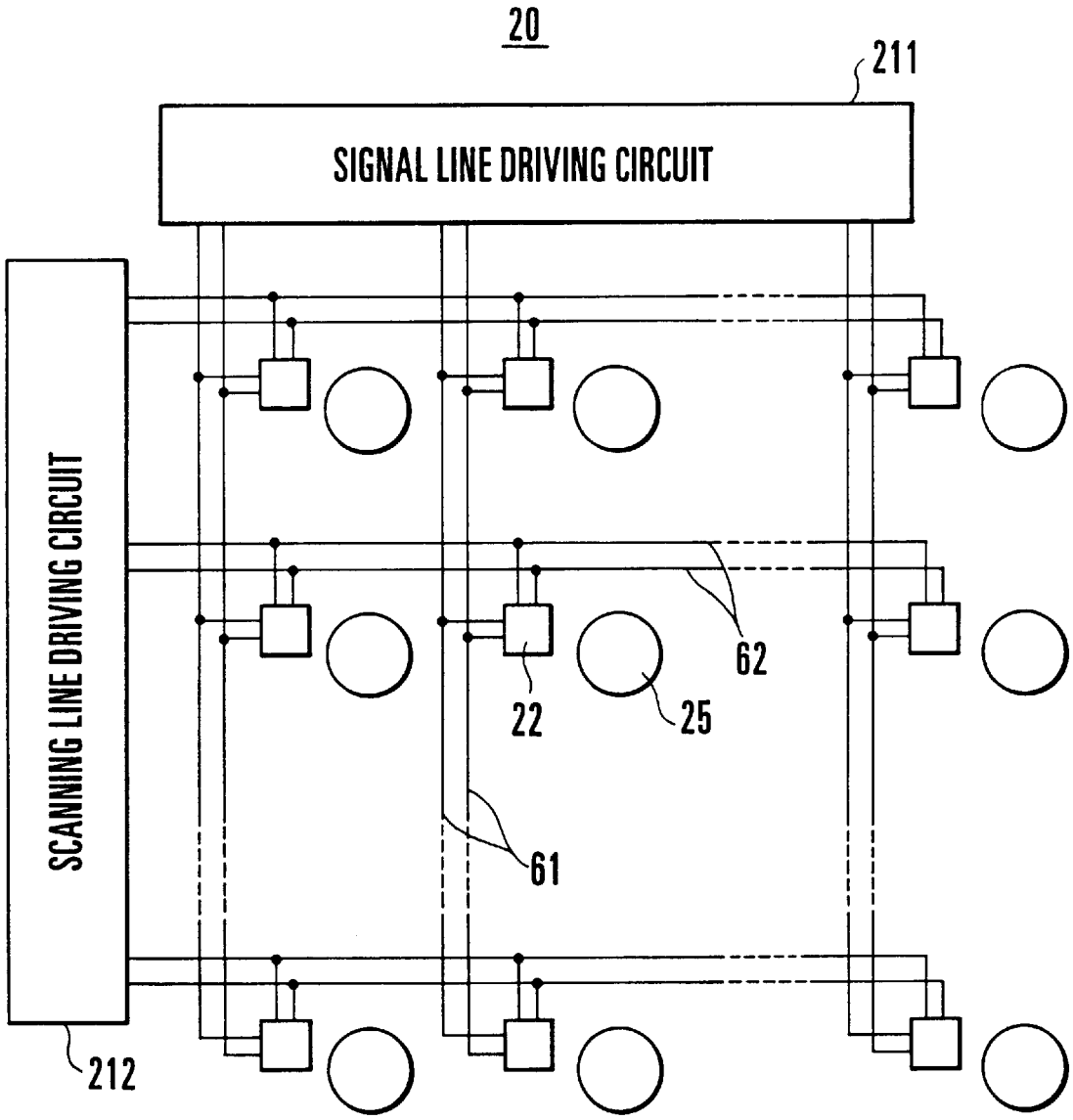
FIG. 4 is a block diagram showing the arrangement of a TFT circuit in FIG. 1.

The TFT circuit 20 in FIG. 1 will be further described. FIG. 4 shows the arrangement of the TFT circuit 20 having the data latch circuits 22 arranged in the form of a matrix.

As shown in FIG. 4, each data latch circuit 22 is connected to signal lines 61 and scanning lines 62. The signal lines 61 are connected to a signal line driving circuit 211. The scanning lines 62 are connected to the scanning line driving circuit 212.

The data latch circuit 22 serves to drive the 4-bit phase shifter 24, and is constituted by the four data latch circuits 22'. Owing to this arrangement, each data latch circuit 22 is connected to the two signal lines 61 and the two scanning lines 62.

The signal line driving circuit 211 and the scanning line driving circuit 212 are included in the data distribution circuit 21 in FIG. 1.

Figure 5:
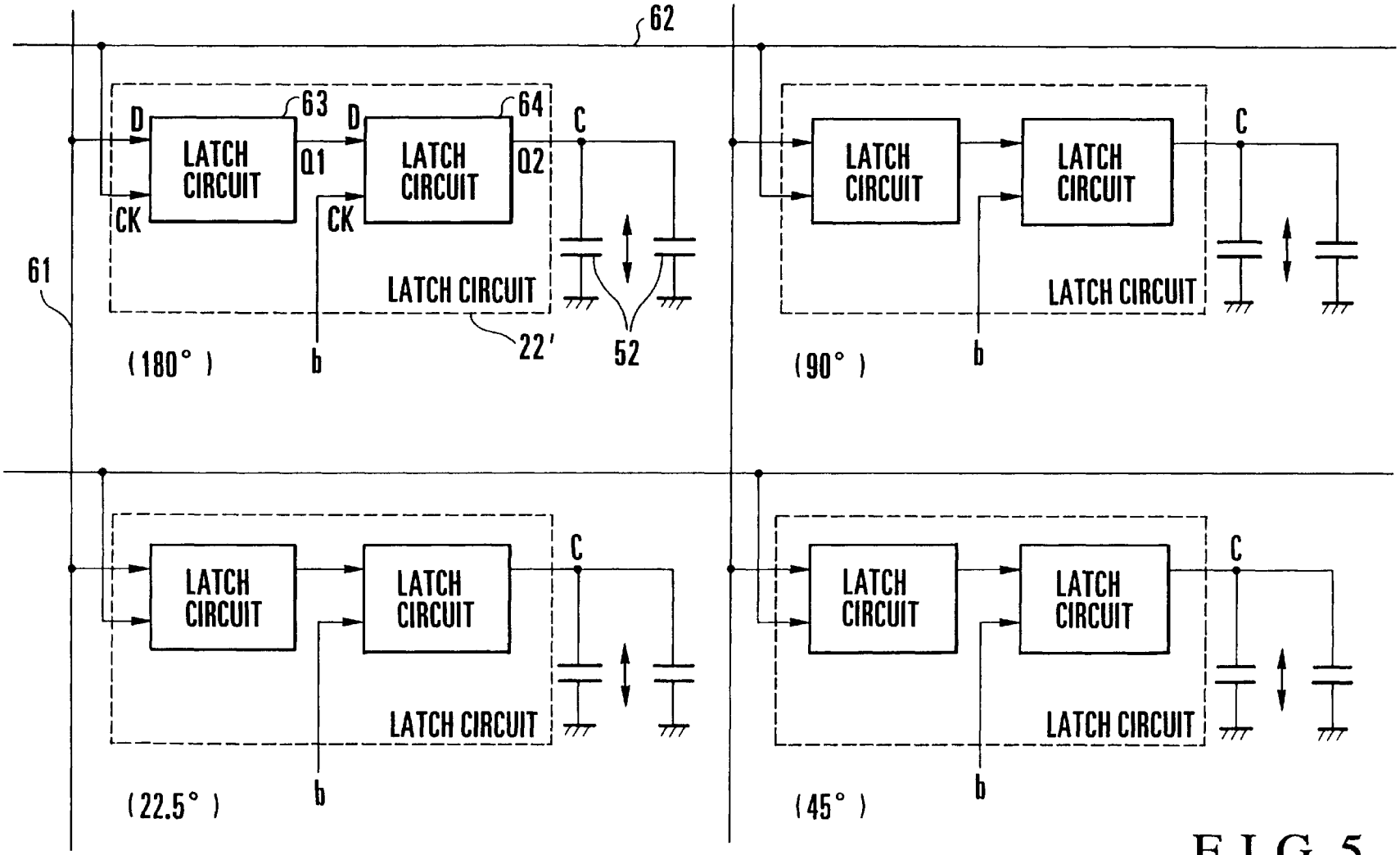
FIG. 5 is a block diagram showing the arrangement of a data latch circuit 22 in FIG. 4.

FIG. 5 shows the arrangement of the data latch circuit 22. The data latch circuit 22 is constituted by the four data latch circuits 22' corresponding to the phase shifting elements 24*a*, 24*b*, 24*c*, and 24*d* with 22.5°, 45°, 90°, and 180° which constitute the 4-bit phase shifter 24.

Each data latch circuit 22' also includes first and second data latch circuits 63 and 64. As the data latch circuits 63 and 64, D flip-flops or the like are used.

The D input terminal and clock input terminal of the data latch circuit 63 are respectively connected to the signal line 61 and the scanning line 62. The D input terminal and clock input terminal of the data latch circuit 64 are respectively connected to the output terminal of the data latch circuit 63 and the control unit 1 in FIG. 1. The timing signal b for changing the beam direction is input to the clock input terminal. The output terminal of the data latch circuit 64 is connected to the two micromachine switches 52 of the phase shifter 24 in FIG. 3.

The data latch circuit 63 holds the control signal a' input from the signal line 61 in synchronism with a scanning pulse (period T) from the scanning line 62. The data latch circuit 64 holds the control signal a' output from the data latch circuit 63 in synchronism with the timing signal b, and applies the driving voltage c to the micromachine switches 52 on the basis of the held control signal a'.

The operation of the data latch circuit 22' in FIG. 5 will be described below. FIGS. 6A to 6E show the operation of the data latch circuit 22'.

Figures 6A, 6B, 6C, 6D, 6E:
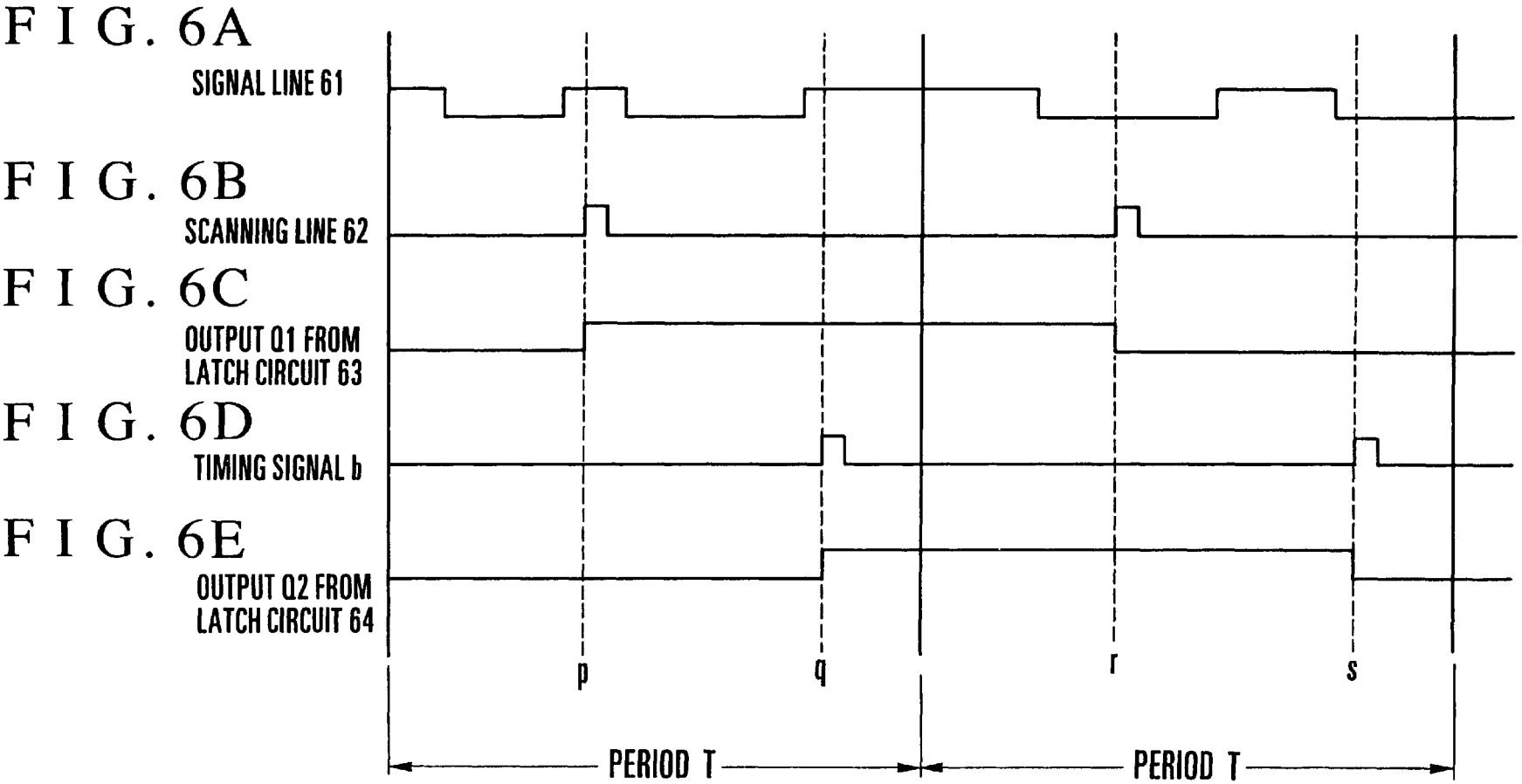
FIGS. 6A to 6E are timing charts showing the operation of a data latch circuit 22' in FIG. 5.

When a scanning pulse is applied to the scanning line 62, the data latch circuit 63 holds the logic level of the control signal a' input from the signal line 61. More specifically, when a scanning pulse is applied to the scanning line 62 at a point p (FIG. 6B), the logic level of the control signal a' on the signal line 61 is at "H" (FIG. 6A). The data latch circuit 63 therefore holds an output Q1 of logic level "H" (FIG. 6C). Even if the logic level of the control signal a' changes afterward, the data latch circuit 63 holds the output Q1 of logic level "H" until a scanning pulse is applied next.

At this time, the data latch circuit 63 keeps outputting the output Q1 of logic level "H" to the D input terminal of the data latch circuit 64. When the timing signal b (FIG. 6D) is output from the control unit 1 to the data latch circuit 64 at a point q, the data latch circuit 64 synchronously holds logic level "H" of the control signal a' output from the data latch circuit 63, and outputs an output Q2 of logic level "H" (FIG. 6E). This output is simultaneously applied as the driving voltage c to the two micromachine switches 52.

When a scanning pulse (FIG. 6B) is applied to the scanning line 62 at point r, since the logic level of the control signal a' input from the signal line 61 at this time is "L", the data latch circuit 63 holds logic level "L". As a result, the output Q1 from the data latch circuit 63 changes to logic level "L".

When the timing signal b is output again from the control unit 1 at a point d, the data latch circuit 64 holds logic level "L" of the output from the data latch circuit 63, and outputs it (Q2). As a result, the application of the driving voltage c to the micromachine switches 52 is stopped.

Since the data latch circuits 64 for holding the control signals a' in synchronism with the timing signal b from the control unit 1 are arranged on the output terminal sides of the data latch circuits 63 connected to the signal lines 61 and the scanning lines 62 in this manner, all the data latch circuits 22' simultaneously output the driving voltages c to the phase shifting elements 24*a* to 24*d* in synchronism with the timing signal b. Radiations from all the radiating elements 25 can therefore be simultaneously switched. By simultaneously switching radiations from all the radiating elements 25 in this manner, the beam direction of the antenna can be greatly changed within a short period of time.

During switching operation of a given microwave switch such as the micromachine switch 52, the phase of the radiating element 25 corresponding to this microwave switch becomes unstable. For this reason, when radiations from all the radiating elements 25 are simultaneously switched, disconnection may occur although the duration of disconnection is short. In contrast to this, when radiations from the radiating elements 25 are to be sequentially switched, a certain number of radiating elements are switched at a time, with time lags, instead of being switched at once, and only some of the radiating element 25 exhibit phase instability. Therefore, the antenna beam direction can be gradually changed while communication is kept ensured.

Consequently, the phased-array antenna preferably has two control schemes, i.e., the scheme of simultaneously switching radiations from all the radiating elements 25 when the antenna beam direction is to be greatly changed within a short period of time, although disconnection occurs for a short period of time; and the scheme of switching radiations from a certain number of radiating elements 25 at a time while ensuring communication when the antenna beam direction is to be gradually changed.

As described above, the control scheme of switching radiations from a certain number of radiating elements 25 at time can also be implemented by the circuit shown in FIG. 5. The control scheme of switching radiations from a certain number of radiating elements 25 at a time will be described below with reference to the timing charts of FIGS. 15A to 15E.

FIGS. 15A to 15E differ from FIGS. 6A to 6E in the following point. Referring to FIGS. 6A to 6E, the timing signal b is instantaneously supplied at the points q and s in the form of pulses. In contrast to this, referring to FIGS. 15A to 15E, the timing signal b is always held at logic level "H".

When the timing signal b supplied to the data latch circuit 64 is always kept at logic level "H" in this manner, a scanning pulse is input to the data latch circuit 63 at the point p, and the logic level of the output Q1 from the data latch circuit 63 changes from "L" to "H". At the same time, the logic level of the output Q2 from the data latch circuit 64 also changes from "L" to "H". This output is applied as the driving voltage c to the micromachine switch 52.

Similarly, at the point s, a scanning pulse is input to the data latch circuit 63. As a result, the logic level of the output Q1 from the data latch circuit 63 changes from "H" to "L". At the same time, the output Q2 from the data latch circuit 64 changes from "H" to "L".

Considering the radiating elements 25 as a whole, it is obvious that only the radiating elements 25 corresponding to the data latch circuits 63 to which scanning pulses are input are sequentially switched.

As is obvious from the above description, according to the circuit shown in FIG. 5, the timing signals b are supplied to the data latch circuits 64 in different manners to implement the two control schemes, i.e., the scheme of simultaneously switching radiations from all the radiating elements 25 and the scheme of switching radiations from a certain number of radiating elements 25 at a time, which schemes are switched depending on the magnitude of change in antenna beam direction.

Figure 7:
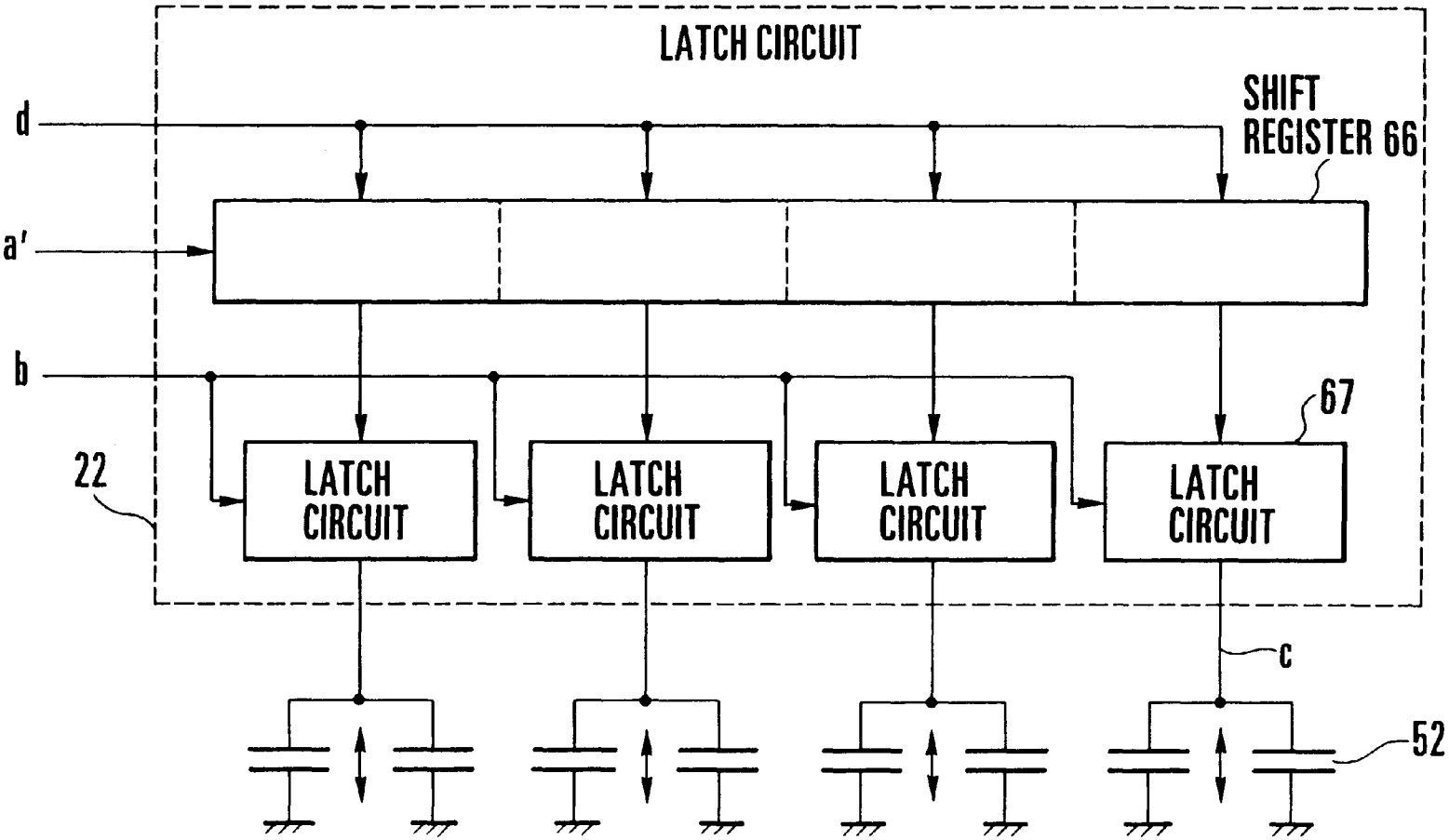
FIG. 7 is a block diagram showing another arrangement of the data latch circuit 22 in FIG. 1.

Another example of the data latch circuit 22 shown in FIG. 1 will be described next. FIG. 7 shows another arrangement of the data latch circuit 22.

The data latch circuit 22 in FIG. 7 serves to drive the 4-bit phase shifter 24. Data latch circuits 67 are connected to the output side of a 4-bit shift register 66 in units of bits, and the two micromachine switches 52 for each bit of the phase shifter 24 are connected to the output side of each data latch circuit 67.

The control signals a' from the data distribution circuit 21 in FIG. 1 are serially output to the shift register 66, and a shift clock signal d is output from the control unit 1 in FIG. 1. In addition, the timing signal b is output from the control unit 1 to the data latch circuits 67.

The shift register 66 is a series input/parallel output type shift register, and outputs the serial control signals a' to the respective data latch circuits 67 parallelly. The data latch circuits 67 hold the control signals a' output from the respective bits of the shift register 66 in synchronism with the timing signal b, and output the driving voltages c to the micromachine switches 52 on the basis of the held control signals a'.

The operation of the data latch circuit 22 in FIG. 7 will be described next.

The control signals a' for controlling driving of the respective bits of the phase shifter 24 are serially output from the data distribution circuit 21 to the shift register 66.

The shift register 66 stores the control signal a' in the first bit upon reception of the clock signal d. Upon reception of the next shift clock signal d, the shift register 66 transfers the control signal a' stored in the first bit to the next bit, and stores the new control signal a' in the first bit. Similarly, the control signal a' stored in a given bit is transferred to the next bit in synchronism with the shift clock signal d.

In the case of a n-bit shift register, therefore, when the shift clock signal d is input n times, the control signal a' stored in the shift register is updated. As described above, since the shift register 66 shown in FIG. 7 is a 4-bit register, the stored control signal a' is updated by inputting the shift clock signal d four times.

When the control signals a' in the shift register 66 are updated after the shift clock signal d is output from the control unit 1 four times, the timing signal b for changing the beam direction is output from the control unit 1 to each data latch circuit 67.

Upon reception of this timing signal b, the respective data latch circuits 67 simultaneously latch the control signals a' output parallelly from the shift register 66, and output the driving voltages c to the respective bits of the phase shifter 24. As a result, similar to the data latch circuits 22, the data latch circuits 67 can simultaneously change the radiating directions of all the radiating elements 25 of the antenna section 2*a*.

The data distribution circuit 21 may output the control signals a' parallelly to the respective bits of the phase shifters 24, as shown in FIG. 1. If, however, the control signals a' are serially output, as shown in FIG. 7, the number of wiring lines between the data distribution circuit 21 and the data latch circuits 22 can be decreased.

The shift register 66 shown in FIG. 7 is provided for each phase shifter 24. If, however, shift registers having many bits are used, one shift register can be provided for a plurality of phase shifters 24. In this case, one data latch circuit 22 can control driving of a plurality of phase shifters 24.

Figure 8:
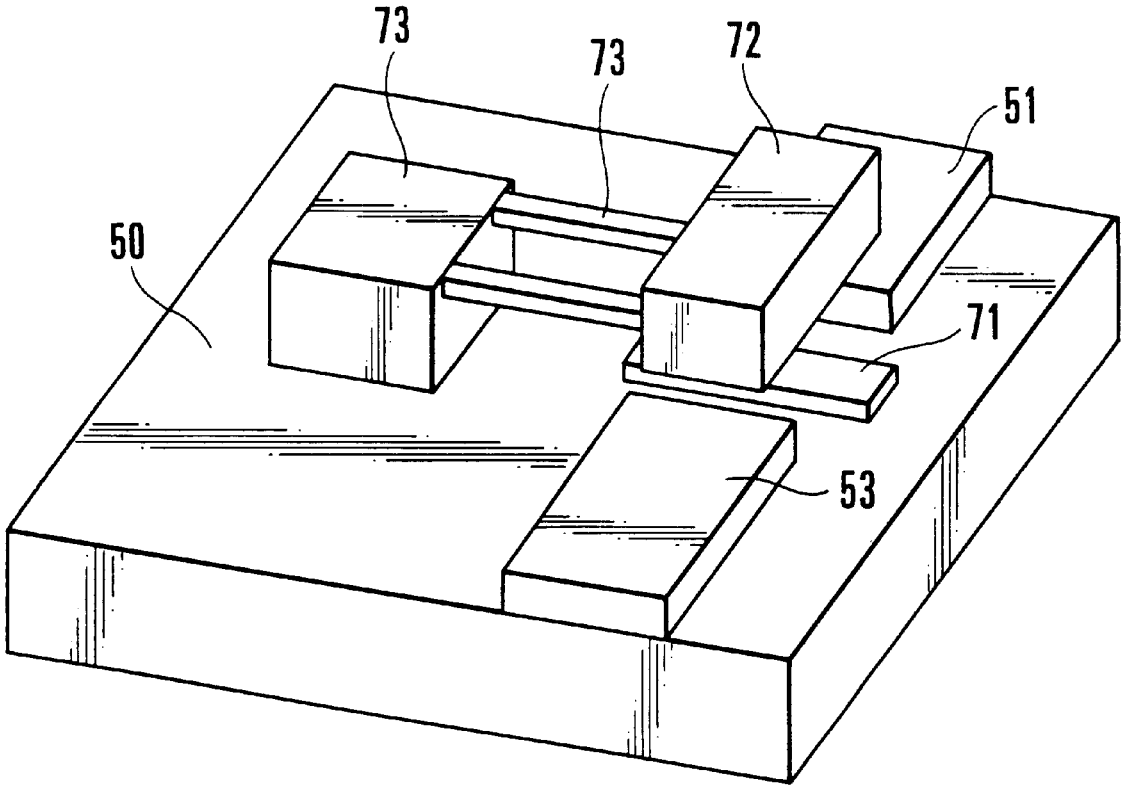
FIG. 8 is a perspective view showing the structure of a micromachine switch in FIG. 3.

The micromachine switches 52 shown in FIG. 3 will be further described next. FIG. 8 shows the structure of each micromachine switch 52 placed between the strip line 51 and the ground 53.

The micromachine switch 52 is constituted by an electrode 71, a finely movable element 72, and a support member 73. The finely movable element 72 and the support member 73 constitute a cantilever.

As shown in FIG. 8, the strip line 51 and the ground 53 are spaced apart from each other on the glass substrate 50.

The electrode 71 is formed between the strip line 51 and the ground 53 on the glass substrate 50 by photolithography. The electrode 71 is not in contact with both the strip line 51 and the ground 53. Although the strip line 51 and the ground 53 are at the same level, the electrode 71 is formed to be sufficiently lower than the strip line and the ground.

The finely movable element 72 is formed above the electrode 71 to oppose the strip line 51, the ground 53, and the electrode 71.

The support member 73 is formed on the glass substrate 50 and cantilevers the finely movable element 72.

Although the electrode 71 and the finely movable element 72 are made of a conductor, the support member 73 may be made of a conductor, a semiconductor, or an insulator.

Figure 9:
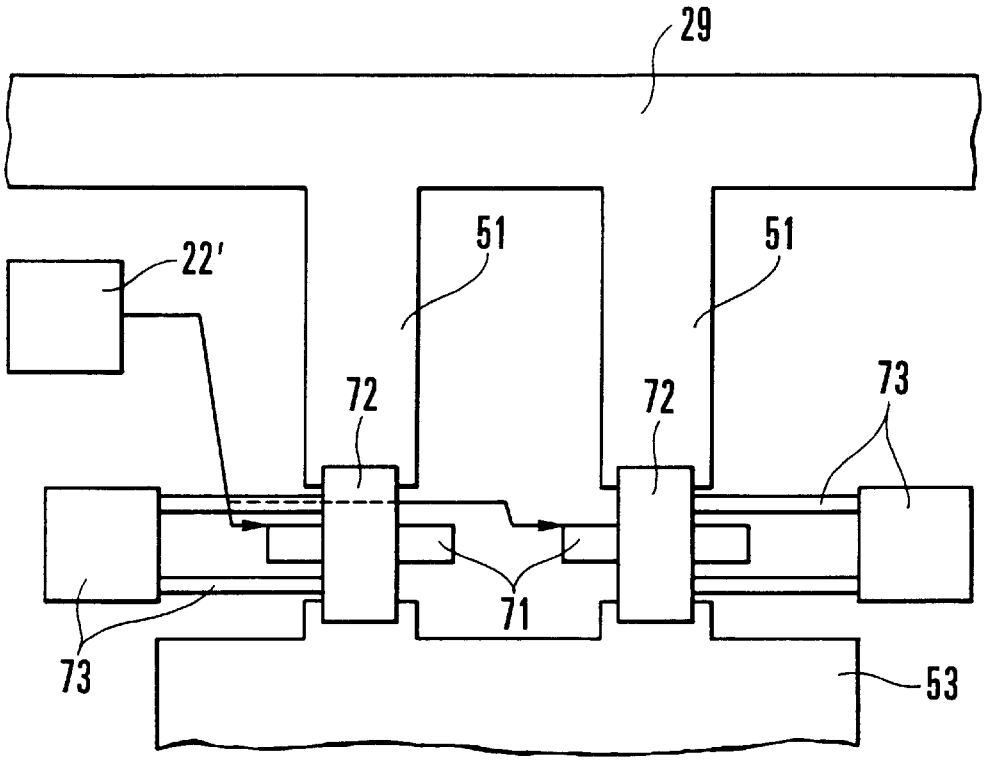
FIG. 9 is a plan view of the micromachine switch in FIG. 8.

FIG. 9 shows the micromachine switches 52 in FIG. 8, and more specifically, the two micromachine switches 52 used for the loaded line type phase shifting elements 24*a* to 24*c*.

As shown in FIG. 9, the two micromachine switches 52 are arranged to be symmetrical about the two strip lines 51. The electrodes 71 respectively included in the two micromachine switches 52 are connected to the output side of one data latch circuit 22'. The driving voltages (external voltages) c are simultaneously applied from the data latch circuit 22' to the electrodes 71.

Figure 10A:
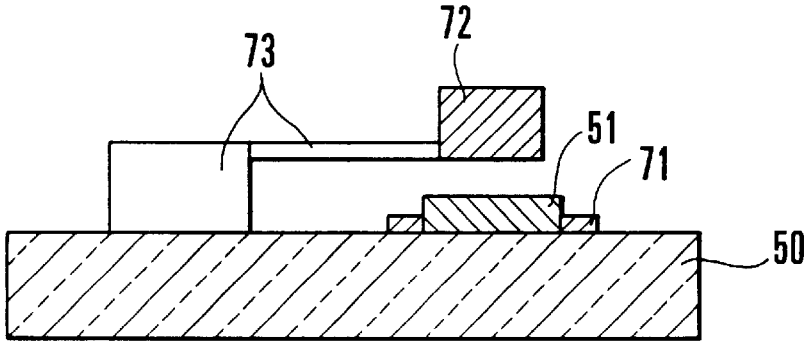
FIGS. 10A and 10B are sectional views of the micromachine switch in FIG. 8.
Figure 10B:
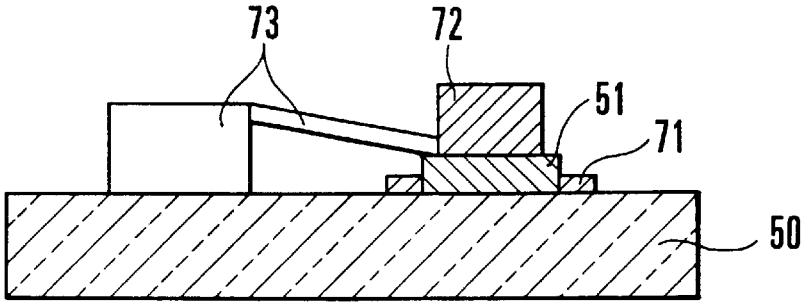

The operation of each micromachine switch 52 will be described next. FIGS. 10A and 10B show the micromachine switch 52 in FIG. 8. FIG. 10A shows the open state of the micromachine switch 52. FIG. 10B shows the closed state of the micromachine switch 52.

When the control signal a' of logic level "L" is output from the data distribution circuit 21, the data latch circuit 22' does not apply the driving voltage c to the electrode 71. At this time, as shown in FIG. 10A, the finely movable element 72 is located above the strip line 51 and the ground 53 and is not contact therewith. The micromachine switch 52 is therefore set in the open state.

In addition, as described above, since the electrode 71 is not in contact with the strip line 51 and the ground 53, the strip line 51 is disconnected. At this time, the phase shifting elements 24*a* to 24*c* do not operate, and the RF signal flowing in the strip line 29 does not flow from the strip line 51 to the ground 53. The feeding phase for the radiating element 25 does not change.

When the control signal a' of logic level "H" is output from the data distribution circuit 21, the data latch circuit 22' applies the driving voltage c to the electrode 71. The driving voltage c applied to the electrode 71 at this time is about 30 V or less.

When the positive driving voltage c is applied to the electrode 71, a positive charge appears on the surface of the electrode 71, and a negative charge appears on the surface of the finely movable element 72 opposing the electrode 71 owing to electrostatic induction. Since an attractive force is generated by the electrostatic force between the positive charge on the electrode 71 and the negative charge on the finely movable element 72, the finely movable element 72 is pulled down to the electrode 71 by this attractive force, as shown in FIG. 10B.

With this operation, since the finely movable element 72 is brought into contact with the strip line 51 and the ground 53, the micromachine switch 52 is set in the closed state. As a result, the strip line 51 is RF-connected to the ground 53 through the finely movable element 72. In this case, the phase shifting elements 24*a* to 24*c* operate, and the RF signal flowing in the strip line flows from the strip line 51 to the ground 53. The feeding phase for the radiating element 25 therefore changes.

Similarly, in the case of the switched line type phase shifting element 24*d,* when the driving voltage c is selectively applied to the electrode 71 of the micromachine switch 52, the finely movable element 72 selectively connects the strip line 51 to the ground 53 or the disconnected strip line 29. As a result, an RF signal flows in the connected portion, and the feeding phase changes.

As described above, the electrode 71 is sufficiently lower than the strip line 51 and the ground 53. For this reason, when the finely movable element 72 comes into contact with the strip line 51 and the ground 53, the finely movable element 72 does not come into contact with the electrode 71.

The micromachine switch 52 shown in FIG. 8 is an ohm coupling type micromachine switch. However, a capacitive coupling type micromachine switch using a cantilever having a dielectric film formed on the lower surface of the finely movable element 72 may be used.

In the micromachine switch 52 shown in FIG. 8, the driving voltage c is applied to the electrode 71. However, the output side of the data latch circuit 22' may be connected to the finely movable element 72, and the driving voltage c may be applied to the finely movable element 72 to generate an electrostatic force between the electrode 71 and the finely movable element 72.

In a conventional phased-array antenna apparatus, a modularized PIN diode has been used as a microwave switch. However, since the PIN diode exhibits a large energy loss on the semiconductor junction surface, the power consumption becomes large.

In contrast to this, according to this embodiment, as described above, since the micromachine switch 52 is used as a microwave switch, the power consumption at the switch can be reduced to about 1/10 or less.

In the present invention as well, if no consideration is to be given to the problem of power consumption, a PIN diode can be used as a microwave switch.

When this embodiment is applied to a phased-array antenna with a size of about 36 cm×36 cm×10 cm and a radiation element count M of 4,000 to 5,000, a high gain of about 35 dBi can be obtained at a frequency of 30 GHz.

(Second Embodiment)

The second embodiment of the present invention will be described next.

Figure 11:
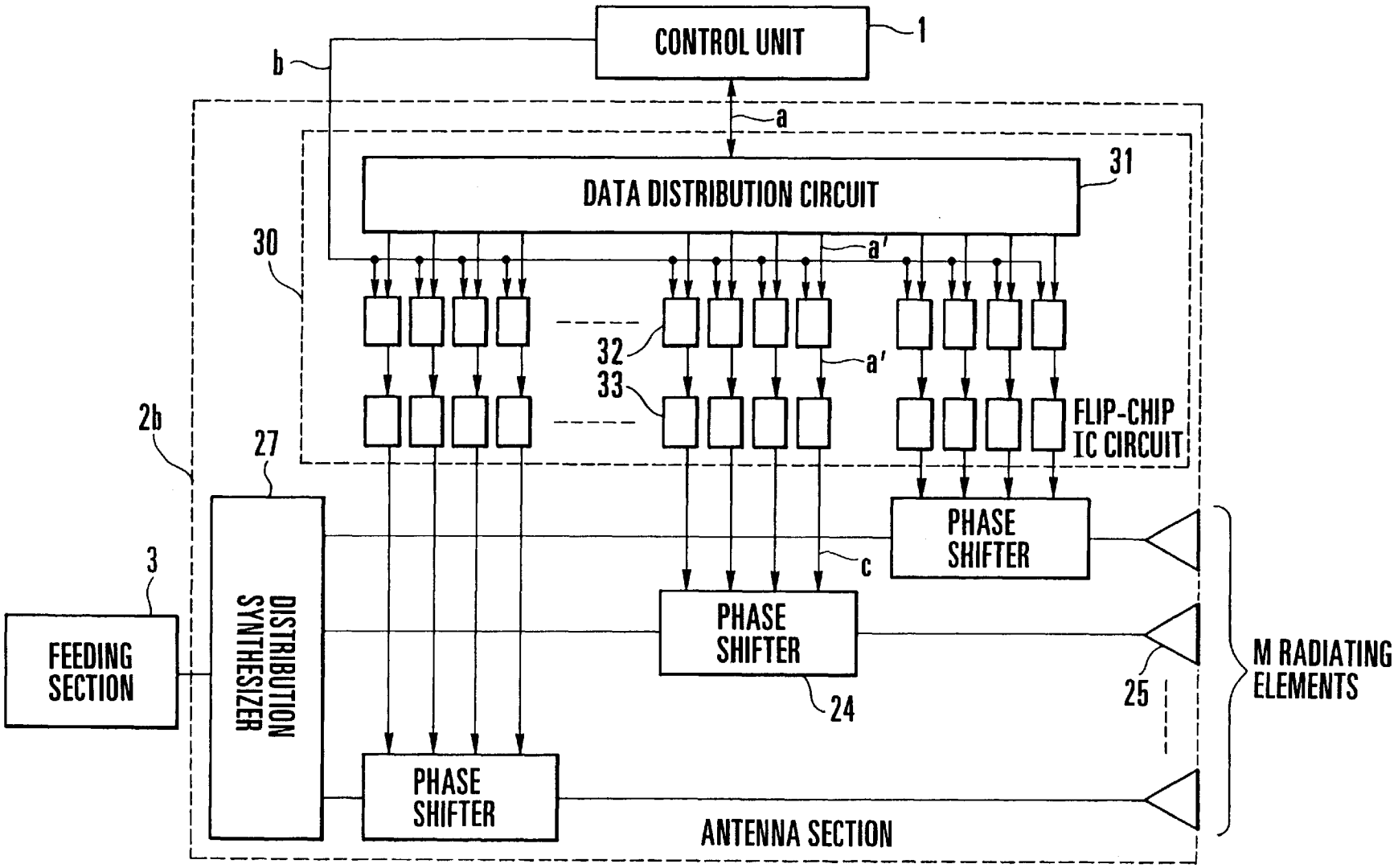
FIG. 11 is a block diagram showing the arrangement of a phased-array antenna apparatus according to the second embodiment of the present invention.

FIG. 11 shows the arrangement of a phased-array antenna apparatus according to the second embodiment of the present invention. The same reference numerals in FIG. 11 denote the same parts as in FIG. 1, and a description thereof will be omitted.

The phased-array antenna apparatus shown in FIG. 11 differs from the one shown in FIG. 1 in that an antenna section 2*b* has a flip-chip IC circuit 30 in place of the TFT circuit 20.

M radiating elements 25 are respectively connected to N-bit phase shifters 24. The phase shifters 24 are connected to a feeding section 3 through a distribution synthesizer 27. The phase shifters 24 are connected to the flip-chip IC circuit (driving means) 30 for driving the phase shifters. The flip-chip IC circuit 30 is connected to a control unit 1.

The flip-chip IC circuit 30 is constituted by data latch circuits 32 and driving circuits 33, which are arranged for the respective bits of the phase shifters 24, and a data distribution circuit 31. The respective bits of the phase shifters 24 are connected to the driving circuits 33. The driving circuits 33 are respectively connected to the data latch circuits 32. The data latch circuits 32 are connected to the data distribution circuit 31. The control unit 1 is connected to the data distribution circuit 31 and the data latch circuits 32.

The control unit 1 outputs control signals a for controlling driving of the respective bits of the phase shifters 24 to the data distribution circuit 31, and also outputs a timing signal b for changing the beam direction to each data latch circuit 32. The data distribution circuit 31 outputs control signals a' to the data latch circuits 32 on the basis of the control signals a. The data latch circuits 32 rewrite the held data in synchronism with the timing signal b, and output the resultant data to the driving circuits 33. The driving circuits 33 output driving voltages c to the respective bits of the phase shifters 24 on the basis of the outputs from the data latch circuits 32.

The distribution synthesizer 27 distributes the RF signal output from the feeding section 3 to output the resultant signals to the phase shifters 24. The phase shift amounts of the phase shifters 24 are set by the driving voltages c applied from the driving circuits 33. The phase shifters 24 change the feeding phases for the radiating elements 25 by the respective phase shift amounts. The radiating elements 25 radiate radio waves with phases corresponding to the feeding phases.

The operation of the phased-array antenna apparatus in FIG. 11 will be briefly described next.

The data latch circuits 32 rewrite the held data into the control signals a' as input data in synchronism with the timing signal b for changing the beam direction, and output the resultant data (control signals a') to the driving circuits 33. As a result, the driving voltages c are simultaneously applied from the driving circuits 33 to the respective bits of the phase shifters 24. The radiating directions of all the radiating elements 25 can be simultaneously changed.

A flip-chip IC having the data latch circuits 32 and the driving circuits 33 shown in FIG. 11 will be described below.

The flip-chip IC is obtained by forming bumps on electrodes without packaging, and joining the bumps and patterns on a substrate directly by soldering or through an anisotropic conductive sheet or the like. Such bumps can be formed on the entire surface of the IC chip instead of being formed on only the peripheral portion of the IC chip. Since wire bonding for connecting the module chips in the IC to the lead pins is not required, unlike a general IC, the area occupied by each IC is small. The packing density increases. Many ICs can therefore be mounted and wired in a small space.

Even if, therefore, the number of phase shifters 24 increases as the number of radiating elements 25 is increased to increase the gain of the antenna, an increase in the size of the phased-array antenna apparatus can be suppressed by using a flip-chip technique to form the driving circuits 33 and the data latch circuits 32 for the phase shifters 24.

Figure 12:
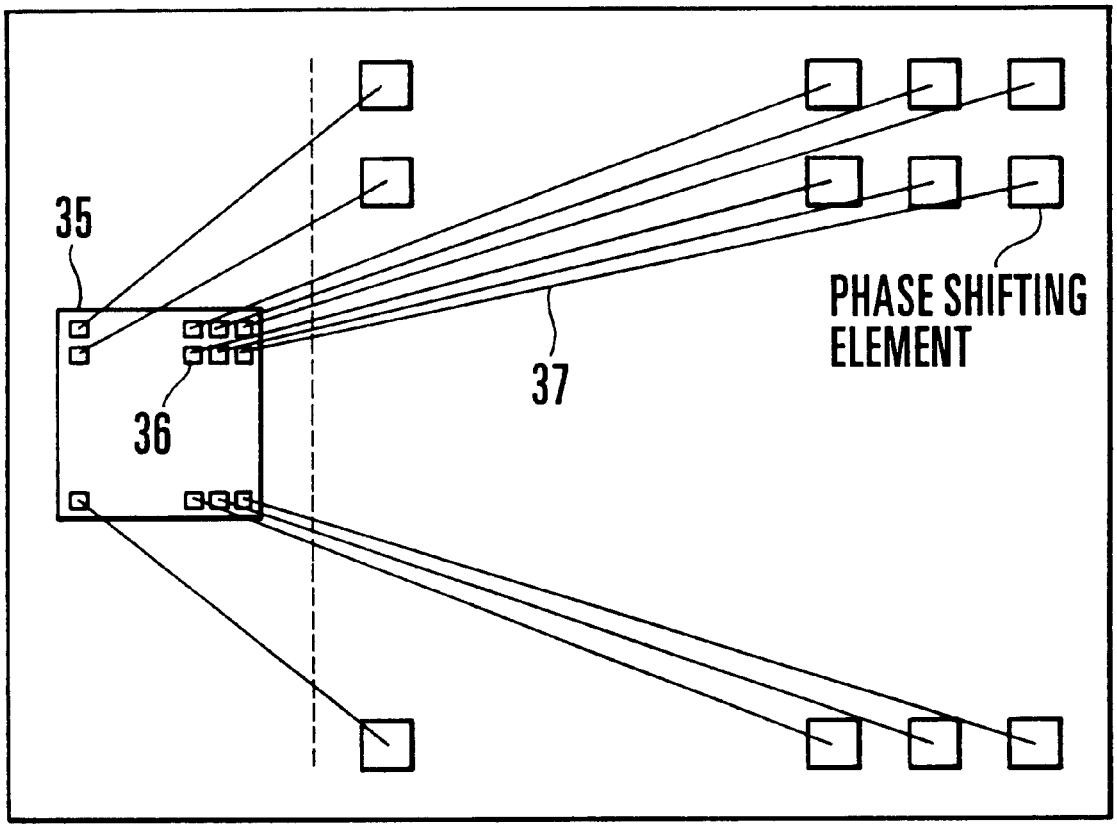
FIG. 12 is a schematic view showing the relationship in connection between a flip-chip IC and phase shifters in the phased-array antenna apparatus in FIG. 11.

FIG. 12 shows the relationship in connection between the flip-chip IC and the phase shifters 24. As shown in FIG. 12, many bumps 36 are formed on the entire surface of a flip-chip IC 35.

The output sides of the respective driving circuits 33 in FIG. 11 are connected to the bumps 36. The bumps 36 are connected to the respective bits of the phase shifters 24 through wiring lines 37 formed by the printed wiring technique.

The printed wring technique includes an etching technique of forming the wiring lines 37 by removing unnecessary portions of a conductive layer formed on a substrate as well as the general printed wiring technique. This applies to the strip line 29 in FIG. 3 and the electrode 71 in FIG. 8.

About 1,000 bumps 36 are formed on the flip-chip IC 35. If, for example, 4-bit phase shifters are used as the phase shifters 24, about 250 radiating elements 25 can be controlled by this flip-chip IC 35.

Note that the spacing between the bumps 36 is about 70 to 100 $\mu$m, and the spacing between the wiring lines 37 is about 1.5 $\mu$m.

The wiring lines 37 for connecting the bumps 36 to the respective bits of the phase shifters 24 are formed on one layer. If, however, the number of radiating elements 25 is increased to increase the gain of the antenna, or the number of bits of each phase shifters 24 is increased to improve the precision in the beam radiating direction, and the number of driving circuits 33 for the phase shifters 24 increases excessively, the wiring lines 37 may be formed in a plurality of layers.

For the sake of descriptive convenience, the driving circuits 33 are described to relate the logic levels of the data latch circuits 32 to the driving voltages c. As is obvious, if a data latch circuit for outputting the driving voltage c when logic level "H" is set is used as each data latch circuit 32, the driving circuits 33 need not be used. That is, the data latch circuits 32 also serve as the driving circuits 33.

As has been described above, according to the present invention, the phase shifters and the phase shifting control circuits for controlling phase shifting of the phase shifters are integrally formed. Therefore, the microwave switches as the switches of the phase shifters are integrally formed with the radiating elements and other portions of the phase shifters. For this reason, the step of mounting modularized switches as in the prior art can be omitted. The manufacturing cost of the phased-array antenna apparatus can therefore be reduced. In addition, since the phase shifters and the phase shifting control circuits are integrally formed, the space for external phase shifter driving ICs can be omitted. The size of the phased-array antenna apparatus can therefore be reduced. In addition, the wiring for controlling the phase shifters can be simplified.

The microwave switches are used to selectively ground the distributed constant circuits. With this operation, the feeding phases for the respective radiating elements can be changed.

If loaded line type phase shifters are used as phase shifters, good characteristics can be obtained with small phase shift amounts. If switched line type phase shifters are used as phase shifters, good characteristics can be obtained with large phase shift amounts.

The microwave switches having electrodes and finely movable elements are used as the switches of the phase shifters, and the circuits are opened/closed by the finely movable elements with the electrostatic forces generated by applying external voltages to the electrodes or the finely movable elements. Since the microwave switches operate with low power, the power consumed by the switches of the phase shifters can be reduced.

Since the radiating elements and the feeding coupling means are arranged on one side of a coordinate axis, and the phase shifters are arranged on the other side, the radiating elements and the phase shifters can be formed in a limited area on one surface of one substrate. For this reason, the number of layers constituting the antenna section as a multilayer structure can be decreased.

Since the driving means for the phase shifters are constituted by flip-chip ICs, the space for phase shifter driving ICs can be reduced as compared with the prior art. The size of the phased-array antenna apparatus can therefore be reduced.

The data latch circuits are arranged in the thin-film transistor circuit, or the data latch circuits are arranged for the flip-chip ICs to simultaneously output external voltages to the respective phase shifters in synchronism with the timing signal. With this operation, the phase shift amounts of the respective phase shifters can be simultaneously changed. The radiating directions of all the radiating elements can therefore be changed at once.

In addition, since the data latch circuits are arranged in the form of a matrix, the number of wiring lines to the thin-film transistor circuit including the data latch circuits can be decreased.

Since the radiating elements are arranged in the form of a matrix, many radiating elements can be arranged within a limited area.

By using a glass substrate as a dielectric substrate, the manufacturing cost can be reduced.

What is claimed is:

1. A phased-array antenna apparatus used in a microwave or millimeter wave band and having a high gain, comprising M individual units arranged in the form of a matrix, each of said individual units comprising:

a radiating element;

a phase shifter coupled to said radiating element to shift a phase of a feeding signal supplied to said radiating element in units of N bits, wherein M and N are positive integers and M is not less than two;

a phase shifting control circuit for controlling phase shifting of said phase shifter; and a feeding unit arranged to be coupled to said radiating element, wherein said phase shifter includes N phase shifting elements, and each of said N phase shifting elements includes distributed constant lines, and microwave switches connected to said distributed constant lines;

said phased-array antenna further comprising a data distribution circuit for distributing control data, which is calculated to obtain a predetermined radiant beam, to scanning and signal lines, respectively, for said phase shifter of each of said M individual units.

* * * * *